United States Patent [19]

Rink

[11] Patent Number: 4,536,037

[45] Date of Patent: Aug. 20, 1985

[54] CUTTING TOOTH FOR STRIP MINING APPARATUS

[75] Inventor: Richard H. Rink, Huron, S. Dak.

[73] Assignee: Huron Manufacturing Corporation, Huron, S. Dak.

[21] Appl. No.: 514,957

[22] Filed: Jul. 18, 1983

[51] Int. Cl.[3] ..... E21B 10/62

[52] U.S. Cl. ..... 299/92; 299/91; 37/142 A; 403/378

[58] Field of Search ..... 299/78, 89, 92, 94; 37/142 A; 403/378, 379

[56] References Cited

U.S. PATENT DOCUMENTS

| | | | |
|---|---|---|---|
| 2,965,365 | 12/1960 | Krekeler | 299/92 |
| 3,285,668 | 11/1966 | Fearon | 299/92 |
| 3,382,005 | 5/1968 | Kiefer | 37/142 A |
| 3,466,772 | 9/1969 | Phillips | 299/92 |
| 3,614,164 | 10/1971 | Davis | 299/92 |
| 3,846,922 | 11/1974 | Horton | 299/82 |
| 4,199,107 | 4/1980 | Bingham | 239/600 |
| 4,200,335 | 4/1980 | Moynihan et al. | 299/1 |
| 4,277,105 | 7/1981 | Taylor | 299/64 |
| 4,303,277 | 12/1981 | Roepke et al. | 299/43 |

FOREIGN PATENT DOCUMENTS

| | | | |
|---|---|---|---|
| 2653074 | 5/1978 | Fed. Rep. of Germany | 299/92 |
| 2835410 | 12/1979 | Fed. Rep. of Germany | 299/92 |
| 1096146 | 12/1967 | United Kingdom | 299/92 |
| 2035418 | 6/1980 | United Kingdom | 299/92 |
| 2035419 | 6/1980 | United Kingdom | 299/92 |

OTHER PUBLICATIONS

Huron Manufacturing Corporation four page color brochure for Model 1224 Continuous Surface Miner.

*Primary Examiner*—Stephen J. Novosad
*Assistant Examiner*—Michael Goodwin
*Attorney, Agent, or Firm*—Dorsey & Whitney

[57] ABSTRACT

A cutting head for a strip mining machine is provided that has a unique arrangement of cutting arms for prolonging the life of the cutting head, which provides for efficient collection of disturbed mineral composite loosened by the cutting arms, and which has improved, replaceable cutting teeth. The improved cutting head comprises a rotatable axle member and a plurality of radially and longitudinally spaced cutting arms projecting generally radially outwardly from the axle member. A detachable cutting tooth is received within a receptacle at the outermost end of each cutting arm in a resilient force fit, and is retained within the receptacle by removable spiral pins. Flighting is provided for urging disturbed composite towards the middle of the cutting head, and the cutting arms in the middle of the cutting head are provided with impelling plates for urging the composite radially outwardly from the cutting head.

8 Claims, 6 Drawing Figures

CUTTING TOOTH FOR STRIP MINING APPARATUS

BACKGROUND OF THE INVENTION

1. Field of the Invention

This invention relates to heavy duty mining apparatus. In particular, it pertains to an improved cutting head for a continuous surface miner.

2. Background Art

Heavy duty continuous surface mining machines provide an efficient means for mining mineral deposits located close to the surface of the earth. Such machines usually take the form of tracked vehicles which are self propelled in a path of travel parallel to the surface of the mineral deposits to be mined. The mining machines include elongated, rotatable, heavy duty cutting heads that are oriented generally perpendicular to the path of travel of the mining vehicle and which include cutting teeth for loosening the mineral deposit into a disturbed composite. The cutting head alone of a continuous surface mining machine may weigh as much as thirty thousand pounds and be as much as seven feet in diameter and thirteen feet in width. The cutting heads may be rotated as fast as 60 revolutions per minute to produce over twenty-five hundred tons of disturbed mineral composite per hour.

Although continuous surface mining machines have proven to be the most cost effective way to mine mineral deposits located close to the surface of the earth, it will be appreciated that the rotation of a massive cutting head in contact with a contiguous mineral deposit places excessive strains on the mining apparatus. In particular, the cutting teeth of the head can experience rapid deterioration, and the bearings that rotatably mount the cutter head to the chassis of a mining machine may be subjected to uneven wear. It will also be appreciated that mineral deposits loosened by the cutting head must be collected in some manner for subsequent transfer of the composite from the mine.

Cutting heads for continuous surface mining machines in the past have been provided with detachable teeth so that worn cutting teeth may be replaced by new teeth. Notwithstanding the detachable nature of conventional cutting head teeth, replacement of such conventional teeth has proven to be an awkward and time-consuming procedure. Moreover, previous continuous surface mining machines have relied solely on the passage of the cutting arms and teeth through the disturbed loosened mineral deposits to throw the loosened composite rearwardly and upwardly to a conveyer belt within the mining machine for collection of the composite. Since the cutting arms and individual cutting teeth supported by the cutting arms are advantageously longitudinally and radially spaced apart from each other, a significant portion of the loosened composite is not contacted by the cutting teeth or arms, and is therefore not collected by the mining machine's conveyer.

SUMMARY OF THE INVENTION

The problems outlined above are in large measure solved by the mining apparatus cutting head in accordance with the present invention. That is to say, the improved cutting head is especially designed for the efficient collection of disturbed mineral deposits, and for the even wear and longer life of the couplings rotatably mounting the cutting head to the chassis of a continuous surface miner. Moreover, the cutting head includes detachable cutting teeth of an improved design that reduces the time required for replacement of worn cutting teeth.

The improved cutting head broadly includes an elongated axle member, and a plurality of cutting arms projecting generally radially outwardly from the axle member. The cutting arms are radially and longitudinally spaced apart from one another, and each cutting arm supports a detachable cutting tooth. Flighting elements interconnect certain of the cutting arms for the urging of loosened composite towards the center of the cutting head, and impelling plates are carried by the cutting arms located in the middle of the cutting head. The plates present concave impelling surfaces for the efficient discharge of loosened composite away from the cutting head.

The improved detachable cutting teeth disclosed herein include a base portion having bottom and top walls that intersect to define a forward cutting edge, a rearwardly projecting insert portion receivable within receptacles in the cutting arms, resilient members for effecting a resilient force fit of the insert portion within a cutting arm receptacle, and a graspable projection extending outwardly from the base portion to facilitate insertion and removal of the teeth from respective cutting arms. The insert portions are positively retained within the cutting arm receptacles by spiral retaining pins.

DETAILED DESCRIPTION OF THE DRAWINGS

Figure 1:
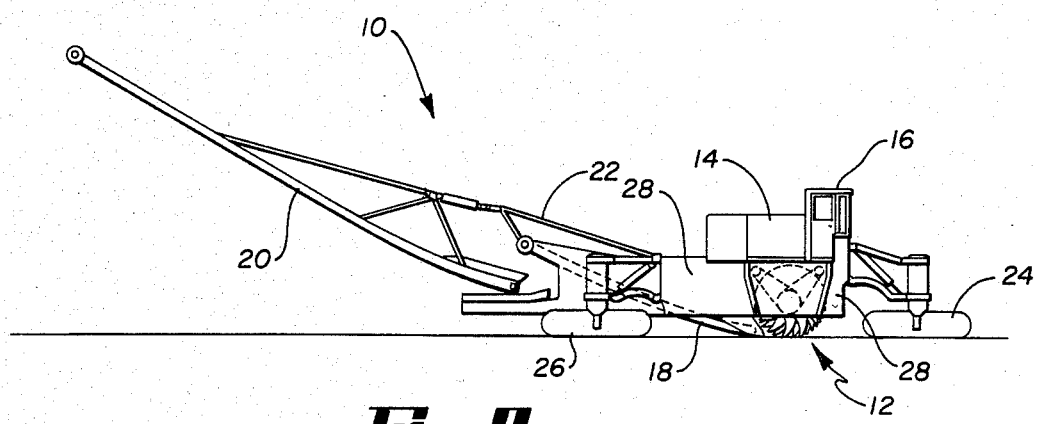
FIG. 1 is a side elevational view of a continuous surface mining machine.

Referring to the drawings, a continuous surface mining machine 10 having an improved cutting head 12 in accordance with the present invention broadly includes a chassis 14, a cab 16 positioned on the uppermost portion of the chassis 14, an internal conveyer belt 18, a removable conveyer 20, and a mount 22 for the removable conveyer 20. The chassis 14 is movably supported by forward and aft pairs of tracks 24, 26. The cutting head 12 is internally mounted within the chassis 14, and supported by the chassis side walls 28.

The cutting head 12 in accordance with the present invention broadly includes an elongated axle member 30 having terminal ends 32, 34, and a plurality of cutter arms 36 projecting generally radially outwardly from the axle member 30. Each of the cutting arms 36 supports a detachable cutting tooth 38 at the outermost end thereof.

Figure 2:
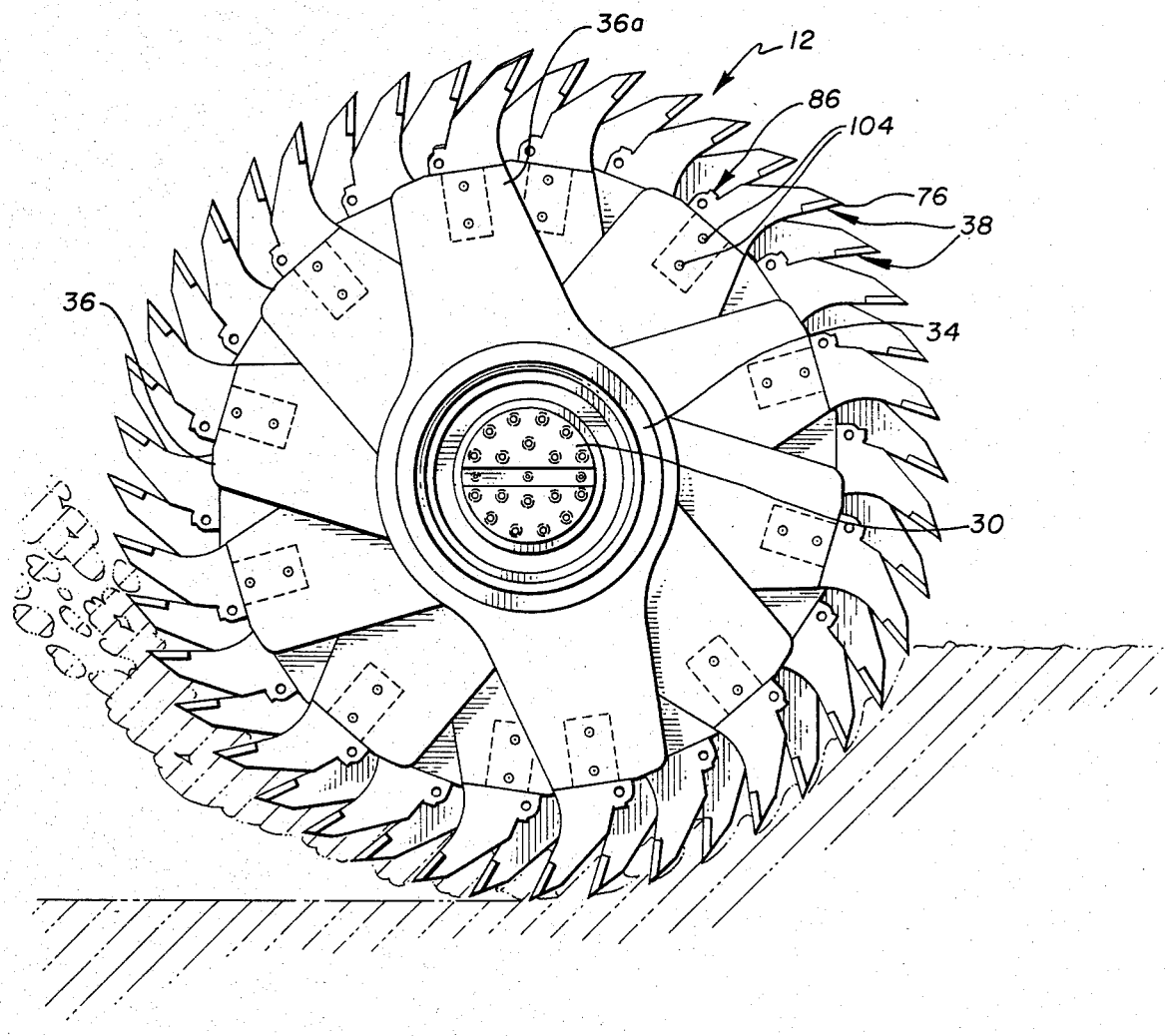
FIG. 2 is a side elevational view of a mining machine cutting head in accordance with the present invention.
Figure 3:
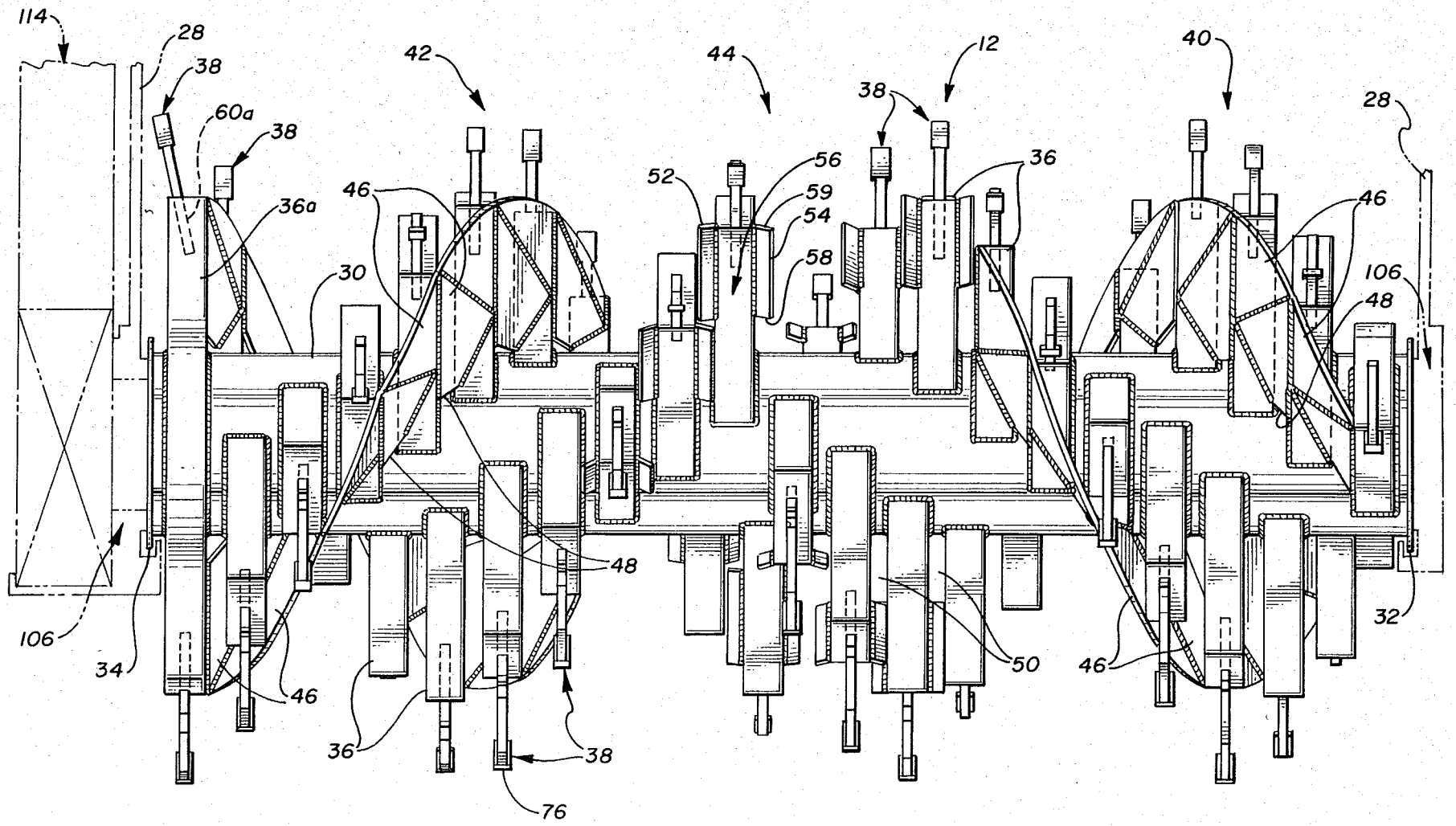
FIG. 3 is a front elevational view of a cutting head in accordance with the present invention, with portions of the mining machine side wall and sprocket drive depicted in phantom lines.

The cutting arms 36 are grouped into a first set 40 of cutting arms extending longitudinally inwardly from the axle member terminal end 32, a second set 42 extending longitudinally inwardly from the axle member terminal end 34, and a third set 44 interposed between the first and second sets 40, 42. Referring in particular to FIGS. 2 and 3, it will be observed that the individual cutting arms 36 are radially and longitudinally spaced apart from one another. In this regard, however, it will be noted that a pair of cutting arms that are radially, but not longitudinally, spaced apart are located immediately inboard of each terminal end 32, 34 of the axle member 30. As best seen in FIG. 2, each cutting arm 36 is radially spaced apart from each of the other cutting arms, and the angular displacement of radially adjacent arms is generally uniform.

The first set 40 of cutting arms 36 are arranged in a pair of parallel helixes. Flighting elements 46 interconnect adjacent ones of the cutting arms 36 within the first set 40. The radially inwardmost margins 48 of the flighting elements 46 are spaced apart from the surface of the axle member 30 presenting gaps between the elements 46 and axle member 30. The cutting arms 36 making up the second set 42 of cutting arms are likewise arranged in double helical, parallel configurations. The cutting arms of the second set 42 are also interconnected by flighting elements 46, having margins 48 spaced apart from the axle member 30. Referring in particular to FIG. 3 it will be noted that the helices defined by the first and second sets 40, 42 of cutting arms 36 are of opposite handed directions.

The helical patterns defined by the first and second cutting arm sets 40, 42 are continued by the cutting arms making up the middle, or third set 44 of cutting arms 36. The cutting arms 36 comprising the third set 44, however, are not interconnected by flighting elements. Each cutting arm 36 within the third set 44 stands alone, and longitudinally extending gaps 50 are defined between adjacent ones of the cutting arms 36 within middle set 44.

Each of the cutting arms 36 within the middle set 44 supports a pair of generally outwardly, longitudinally extending plates 52, 54. Each pair of plates 52, 54, in conjunction with its respective cutting arm 36, presents a generally radially extending impelling surface 56. The plates 52, 54 are preferably welded to the cutting arms 36, and are symmetrically turned in towards one another such that the impelling surfaces 56 have a generally concave configuration. Each of the plates 52, 54 has a lower margin 58 spaced apart from the surface of axle member 30, and an upper margin 59 spaced apart radially inwardly from the cutting edge of the cutting tooth 38 supported by the respective cutting arm 36. The plate pairs associated with respective cutting arms 36 of the middle set 44 are radially spaced apart from one another. The plates 52, 54, however, extend across the gaps 50 presented between adjacent ones of cutting arms 36 in middle set 44 and longitudinally overlap such that a continuous cylindrical surface is enscribed by the plates 52, 54 upon rotation of the cutting head 12.

Figure 4:
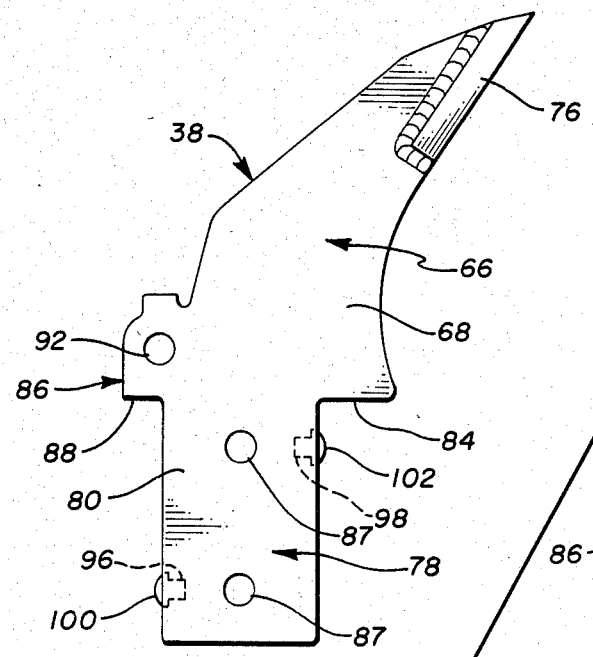
FIG. 4 is a side elevational view of a detachable cutting tooth in accordance with the present invention.
Figure 5:
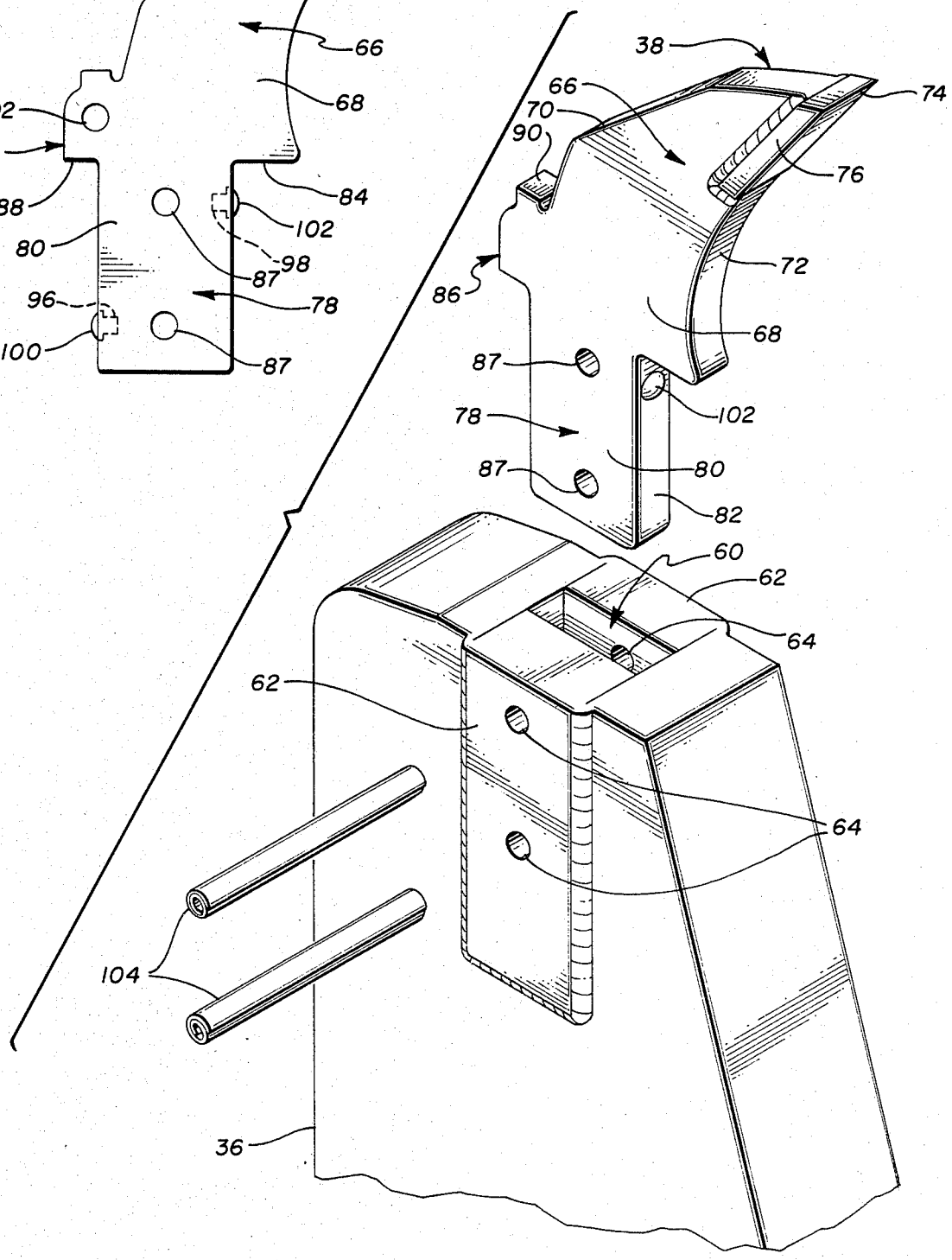
FIG. 5 is a fragmentary, exploded view of a cutting arm and detachable cutting tooth in accordance with the present invention.

Referring now to FIGS. 4 and 5, each cutting arm 36 includes a tooth receiving receptacle 60. As illustrated in FIG. 3, the orientations of the receptacles 60 are for the most part along the axis of respective cutting arms 36. Referring to the uppermost cutting arm **36*a*, as depicted in FIG. 3, at the terminal end 34 of the cutting head 12, however, it will be observed that the receptacle 60*a* is oriented at an angle to the cutting arm axis. The cutting arm receptacle associated with one cutting arm at terminal end 32 (arm not shown), is also oriented at a angle to the cutting arm axis. Each receptacle 60 is defined by a pair of opposed blocks 62 received within and welded to a clevis mouth defined at the outermost end of the cutting arm 36. The opposed blocks 62 include pairs of aligned, bored through channels 64**.

Each cutting tooth 38 includes a base portion 66 defined by a pair of opposed side walls 68, and generally accurate top and bottom walls 70, 72. The top and bottom walls 70, 72 intersect to define cutting edge 74. A carbide insert 76 is included within the base portion 68; the forward and lower side walls of the carbide insert 76 defining in part the top and bottom walls 70, 72 of base portion 66. Referring to FIG. 3, it will be observed that the width of the carbide insert 76 is greater than the width of the base portion 66.

The cutting tooth 38 includes a rearwardly extending insert portion 78 integrally connected to the base portion 66. The insert portion 78 includes side walls 80 that are continuous with respective side walls 68 of the base portion 66. The bottom wall 82 of the insert portion is recessed from the bottom wall 72 of the tooth base portion 68 such that a base portion rear wall 84 is presented. A pair of linearly aligned bored through channels 87 extend between the side walls 78 of the insert portion 78.

An upwardly extending projection 86 is integrally connected to the tooth base portion 66. The projection 86 presents a rearwardly facing wall 88 that is generally linearly aligned with the base portion rear wall 84. The projection 86 includes a front wall 90 that is in parallel alignment with the projection rear wall 88. The projection 86 further includes a bored through channel 92.

The top and bottom walls of the insert portions of the tooth portions 78 include rivet receiving bores 96, 98 respectively. Resilient, rubber rivets 100, 102 are received within the bores 96, 98. Removable spiral pins 104 are received through cutting arm channels 64 and tooth insert portion channels 87.

Figure 6:
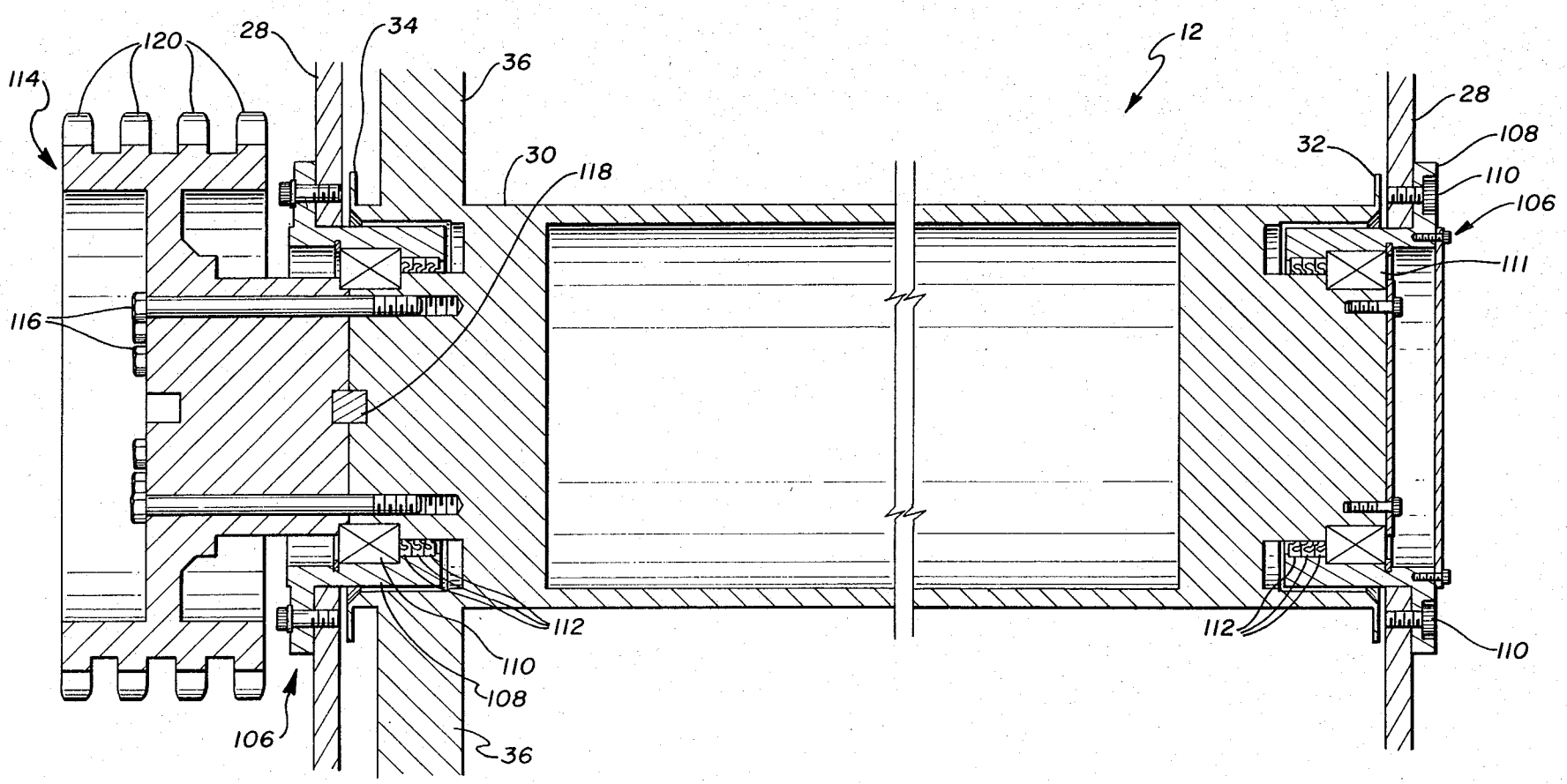
FIG. 6 is a fragmentary, axial sectional view of a cutting head in accordance with the present invention mounted to the side walls of a mining machine chassis, with most of the cutting arms removed for clarity.

Referring to FIG. 6, the cutting head axle member 30 is supported between the side walls 28 of the mining apparatus 10 by supports 106. Each support 106 includes a bearing housing 108 fixedly secured to respective side walls 28 by bolts 110. Axle member 30 is rotatably supported by bearing housings 108. Bearings 111, and oil seals 112 are interposed between the cutting head axle member 30 and the bearing housings 108. Drive sprocket gear 114 is fixedly connected to cutting head axle member 30 at one end thereof by drive sprocket bolts 116. Key 118 is interposed between sprocket gear 114 and axle member 30. Sprocket gear 114 includes four sprocket runs 120 to accommodate four drive chain runs of a single drive chain (not shown).

In operation, the mining apparatus 10 is operated in a forward path of travel across the surface of a contiguous mineral deposit. The cutting head 12 is rotated in a clockwise direction, from the perspective of FIGS. 1 and 2, as the mining machine 10 moves. As each tooth 38 penetrates the surface of the mineral deposit, the mineral deposit is loosened into a disturbed composite. The loosened mineral composite is urged longitudinally inwardly along the cutting head 12 by the flighting elements 46. The loosened composite is then acted upon by the middle set 44 of cutting arms 36 and the impelling surfaces 56 presented by the plates 52, 54, and is urged radially away from the cutting head. The loosened composite impelled away from the cutting head 12 is collected by the internal conveyer 18 of the mining machine 10.

The cutting teeth 38*a* at the terminal ends of the cutting head 12 are flared outwardly. The cutting teeth 38*a* therefore loosen the mineral deposit beyond the terminal ends of the cutting head 12 such that the cutting arms at the terminal ends of the cutting head 12 will not impinge against nonloosened mineral deposit.

As described above, radially adjacent cutting arms 36 are spaced apart by a generally uniform angular displacement. For this reason, an equal number of cutting teeth 38 will have penetrated the surface of the mineral deposit at any one time. Moreover, only one tooth 38 will initially penetrate the surface of the mineral deposit at a time. The load carried by the cutting head 12, therefore, will be generally uniform during operation of the mining machine 10, thereby increasing the life of the cutting head, and in particular the life of the cutting head supports 106.

The unique configuration of the cutting teeth 38 reduces the amount of wear experienced by the teeth, and greatly facilitates replacement operations when the teeth do become worn. The rubber rivets 100, 102 provide the teeth 38 with resilient force fits within cutting arm receptacles 60, thereby reducing the shifting of the teeth 38 within receptacles 60. The linear alignment of rear walls 84 and 88 enables automatic alignment of tooth channels 87 and cutting arm channels 64 upon insertion of a tooth 38 within a receptacle 60. The channel 92 in tooth projection 86 is easily graspable by an appropriate tool for retraction of a tooth 38 from an associated receptacle 60. The front wall 90 of projection 86 provides a surface perpendicular to the direction of insertion of a tooth 38 into a receptacle 60. Force may be applied to the front wall 90 by a striking implement to aid in the insertion process.

What is claimed is:

1. A replaceable cutting tooth for the cutting head of a mining machine or the like, said cutting head including a cutting arm for shifting said tooth through a cutting path of travel and said cutting arm having a plurality of inwardly facing side walls defining a tooth receiving receptacle therein and structure defining a first cutting arm retaining pin receiving channel, comprising:

a base portion having opposed, generally parallel first and second side walls and generally arcuate top and bottom walls interconnecting said side walls, said top and bottom walls intersecting with each other to define a forwardmost cutting edge;

an insert portion operably connected to and extending rearwardly from said base portion, including— a pair of opposed insert portion sidewalls depending from said base portion sidewalls to coextensively define cutting tooth sidewalls;

structure defining a first cutting tooth retaining pin receiving channel extending between said insert portion sidewalls, and oriented generally perpendicular to said path of travel;

opposed insert portion top and bottom walls interconnecting said insert portion sidewalls, and oriented generally perpendicular to said path of travel;

structure defining a first insert portion cavity opening to said insert portion top wall, and a second insert portion cavity opening to said insert portion bottom wall;

first and second resilient, elastomeric members received within said first and second insert portion cavities respectively, said resilient members projecting beyond the surface of said insert portion in abutting relationship with the sidewealls of said cutting arm tooth receiving receptacle for providing said insert portion with a resilient, shock absorbing force fit within said cutting arm receptacle; and a first retaining pin removably received within said first cutting tooth retaining pin receiving channel and said first cutting arm channel for removably locking said cutting tooth within said cutting arm tooth receiving receptacle.

2. A cutting tooth as claimed in claim 1, said resilient members comprising rubber rivets.

3. A cutting tooth as claimed in claim 1, said insert portion being recessed from said base portion bottom wall to present a base portion rear wall, said tooth including a projection extending upwardly from said base portion top wall, said projecting including a rear wall generally collinear with said base portion rear wall, said base portion and projection rear walls limiting the depth to which said tooth may be received within said receptacle.

4. A cutting tooth as claimed in claim 3 said projection including a front wall generally parallel to said projection rear wall for enabling said tooth to be force fit into said receptacle by the application of force to said front wall.

5. A cutting tooth as claimed in claim 2, said projection including a bored through channel for grasping of said projection to assist in retraction of said tooth from said receptacle.

6. A cutting tooth as claimed in claim 1, said first resilient elastomeric member being aligned, along the direction of said path of travel, with said first cutting tooth retaining pin receiving channel.

7. A cutting tooth as claimed in claim 6, said cutting arm including structure defining a second cutting arm retaining pin receiving channel, said insert portion including structure defining a second cutting tooth retaining pin receiving channel extending between said insert portion sidewalls, said cutting tooth including a second retaining pin removably received within said second cutting tooth retaining pin receiving channel and said second cutting arm channel, said second resilient, elastomeric members being aligned along said path of travel with said second cutting tooth retaining channel.

8. A cutting tooth as claimed in claim 7, said first cutting tooth retaining pin receiving channel interposed, within said insert portion, between said second cutting tooth retaining pin receiving channel and said base portion, said first resilient member being aligned forwardly of said first cutting tooth pin receiving channel along the direction of said path of travel, and said second resilient member being aligned rearwardly of said second cutting tooth pin receiving channel along said path of travel.

* * * * *